US005650255A

United States Patent [19]

Ng et al.

[11] Patent Number: 5,650,255

[45] Date of Patent: Jul. 22, 1997

[54] LOW SHEAR TONER AGGREGATION PROCESSES

[75] Inventors: T. Hwee Ng, Mississauga; Arthur Helbrecht; Raj D. Patel, both of Oakville; Grazyna E. Kmiecik-Lawrynowicz, Burlington; David Kurceba, Hamilton; Francisco E. Torres, Mississauga; David J. Sanders, Oakville, all of Canada

[73] Assignee: Xerox Corporation, Stamford, Conn.

[21] Appl. No.: 706,880

[22] Filed: Sep. 3, 1996

[51] Int. Cl.[6] ..... G03G 9/087

[52] U.S. Cl. ..... 430/137; 523/334; 523/339

[58] Field of Search ..... 430/137; 523/334, 523/339

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,370,964 | 12/1994 | Patel et al. | 430/137 |
| 5,391,456 | 2/1995 | Patel et al. | 430/137 |
| 5,403,693 | 4/1995 | Patel et al. | 430/137 |

*Primary Examiner*—Roland Martin
*Attorney, Agent, or Firm*—E. O. Palazzo

[57] ABSTRACT

An in situ chemical process for the preparation of toner comprised of (i) the provision of a latex, which latex is comprised of polymeric resin particles, an ionic surfactant and a nonionic surfactant;

(ii) providing a pigment dispersion, which dispersion is comprised of a pigment solution, a counterionic surfactant with a charge polarity of opposite sign to that of said ionic surfactant, and optionally a charge control agent;

(iii) mixing said pigment dispersion with said latex with a stirrer equipped with an impeller, stirring at speeds of from about 100 to about 900 rpm for a period of from about 10 minutes to about 150 minutes;

(iv) heating the above resulting blend of latex and pigment mixture to a temperature below about the glass transition temperature (Tg) of the resin to form electrostatically bound toner size aggregates;

(v) adding further aqueous ionic surfactant or stabilizer in the range amount of from about 0.1 percent to 5 percent by weight of reactants to stabilize the above electrostatically bound toner size aggregates;

(vi) heating said electrostatically bound toner sized aggregates above about the Tg of the resin to form toner size particles containing pigment, resin and optionally a charge control agent;

(vii) optionally isolating said toner, optionally washing with water; and optionally (viii) drying said toner.

25 Claims, No Drawings

LOW SHEAR TONER AGGREGATION PROCESSES

BACKGROUND OF THE INVENTION

The present invention is generally directed to toner processes, and more specifically, to aggregation and coalescence processes for the preparation of toner particles. In embodiments, the present invention is directed to an in situ chemical toner preparation without the utilization of the known pulverization and/or classification methods, and wherein in embodiment toner particles with an average volume diameter of from about 1 to about 25, and preferably from 1 to about 10 microns and narrow GSD of, for example, from about 1.16 to about 1.26 as measured on the Coulter Counter can be obtained, and wherein the reactor agitator is equipped with an impeller to mix the pigment dispersion and the latex, wherein the mixing results in a low shear thereby avoiding the disadvantages of high shear devices such as a homogenizer. These disadvantages include the malfunctioning of the equipment, such as seal leaks, resulting in loss of materials and shearing efficiency, loss of materials in the recirculating lines, resulting in lower toner yields, additional piping and equipment costs, and extra maintenance costs. The resulting toners produced with the use of high shear devices, and more specifically, at high shear speeds, for example a rotor stator operating a 3,000 to 18,000 RPM, have a major disadvantage and that is the process time is extended for a period of time of up to about 29 percent, compared to the process time wherein these is selected a low shear device. The resulting toners produced in accordance with the present invention can be selected for known electrophotographic imaging, printing processes, including color processes, and lithography. In embodiments, the present invention is directed to a process comprised of dispersing a latex or emulsion mixture comprised of suspended submicron resin particles of from, for example, about 0.01 micron to about 1 micron or less in volume average diameter in an aqueous solution containing an ionic surfactant in amounts of from about 1 percent to about 10 weight percent and nonionic surfactant in amount of from about 0 percent to about 5 weight percent, and shearing this mixture at low, or slow speeds of from about 100 to about 900 and preferably from about 150 to about 600 revolutions per minute (rpm) with a pigment dispersion and optionally toner additives like a charge control agent, and which dispersion contains a counterionic surfactant with opposite charge to the ionic surfactant of the latex in an amount of from about 0.5 percent (weight percent throughout unless otherwise indicated) to about 10 percent, thereby causing a flocculation of resin particles, pigment, and optional charge control agent, followed by heating at about 5 to about 40° C. below the resin Tg and preferably about 5 to about 25° C. below the resin Tg while stirring of the flocculent mixture which is believed to form statically bound toner aggregates of from about 1 micron to about 10 microns in volume average diameter comprised of resin, pigment and optionally charge control particles; adding further surfactant in order to stabilize the aggregates, and thereafter, heating the formed bound aggregates about above the Tg (glass transition temperature) of the resin. The size of the aforementioned statistically bonded aggregated particles in embodiments can be controlled by adjusting the temperature in the below the resin Tg heating stage. An increase in the temperature causes an increase in the size of the aggregated particle. This process of aggregating submicron latex and pigment particles is kinetically controlled, that is the temperature increases the process of aggregation. The temperature also controls in embodiments the particle size distribution of the aggregates, for example the higher the temperature the narrower the particle size distribution, and this narrower distribution can be achieved in, for example, from about 0.5 to about 24 hours and preferably in about 1 to about 3 hours time. The addition of more, or extra stabilizer followed by heating the mixture above or in embodiments equal to the resin Tg generates toner particles with, for example, an average particle volume diameter of from about 1 to about 25, preferably 10 microns, containing pigment and polymer.

The present invention in embodiments relates to the preparation of toners comprised of thermoplastic resin and pigment, and wherein the preparation comprises an emulsion/aggregation/coalescence method as indicated herein, wherein low shear is selected, and wherein a latex of resin containing an anionic surfactant and a nonionic surfactant is mixed with a water dispersion of pigment and a cationic surfactant to form a homogeneous gel at a viscosity of from about 300 centipoise to about 1,200 centipoise. High viscosity, for example 1,000 to 1,200 centipoise, usually requires the use of a high shear stator rotator device, such as a polytron at high speeds (3,000 to 18,000 rpm) for blending for a period of 5 to 30 minutes, during which time the mixture is continuously being recycled to achieve a homogeneous blend of pigment and latex particles. These homogeneous blends can now also be obtained by the invention process using a reactor agitator equipped with turbine blades and stirring at speeds of from about 100 to 900 rpm, and preferably at low speeds of from about 150 to about 600 rpm, for an effective period of time such as, for example, from about 10 minutes to about 150 minutes. Toner compositions, or toner particles of excellent volume average diameter, superior GSD, for example of 1.20, and the like are obtainable with the processes of the present invention.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD.

Emulsion/aggregation processes for the preparation of toners are illustrated in a number of patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersions and narrow GSD, and wherein low, such as from about 100 to about 900 rpm, mixing or stirring is selected.

It is another object of the present invention to provide a process which eliminates the need of a high shear device, such as a homogenizer, thereby further eliminating the need for recirculating lines and thus increasing the reactor throughput or yield.

In another object of the present invention there are provided simple and economical in situ processes for black and colored toner compositions by an aggregation process, and wherein high yields of toner, for example 98 to 99 percent yield, and wherein high shear homogenizers can be avoided, thereby enabling a simpler less costly process, and which process is more reliable in embodiments of the present invention.

In a further object of the present invention there is provided a process for the preparation of toner compositions with an average particle volume diameter of from between about 1 to about 20 microns, and preferably from about 1 to about 7 microns, and with a narrow GSD of from about 1.2 to about 1.3 and preferably from about 1.16 to about 1.20 as measured by a Coulter Counter.

In a further object of the present invention there is provided a process that is rapid as, for example, the aggregation time can be reduced to below 1 to 3 hours by increasing the temperature from room, about 25° C., temperature (RT) to a temperature below 5° to 20° C. Tg, and wherein the process consumes from about 2 to about 8 hours.

In another object of the present invention there is provided a composite toner of polymeric resin with pigment and optional charge control agent in high yields of from about 90 percent to about 100 percent by weight of toner without resorting to classification, and wherein low shear is utilized.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation, after mixing the anionically charged latex particles containing a nonionic surfactant, with cationically charged pigment particles dispersed in water and a nonionic surfactant, resulting in a charge neutralization wherein the latex and pigment particles aggregate resulting in aggregated particles of toner size which then can be coalesced by, for example, heating above the resin Tg in the presence of extra added anionic surfactant. In embodiments, some factors of interest with respect to controlling particle size and particle size distribution include the concentration of the surfactant used for the pigment dispersion, the concentration of the resin component like acrylic acid in the latex, the temperature of coalescence, and the time of coalescence.

In another object of the present invention there are provided processes for the preparation of toner comprised of resin and pigment, which toner can be of a preselected size, such as from about 1 to about 10 microns in volume average diameter, and with narrow GSD by the aggregation of latex or emulsion particles, which aggregation can be accomplished with stirring in excess of 25° C., and below the Tg of the toner resin, for example at 50° C., followed by the addition of extra nonionic surfactant in the amount of 0.1 percent to 5 percent by weight of the reactor contents to stabilize the electrostatically bound aggregates, followed by heating the formed aggregates above about the resin Tg to allow for coalescence; an essentially three step process of blending, aggregation and coalescence; and which process can in embodiments be completed in 8 or less hours. The process can comprise dispersing pigment particles in the form of dry or presscake in water/cationic surfactant using microfluidizer or attritor, or utilizing predispersed pigments wherein the pigment is already in submicron size; blending the pigment dispersion with a latex using an ordinary pitch blade turbine stirrer at speeds of 100 to 900 rpm to break initially formed flocks or floes, thus allowing controlled growth of the particles and better particle size distribution; and then heating up to 45° C. or 50° C. to perform the aggregation. Negatively charged latex particles are aggregated with pigment particles dispersed in cationic surfactant, and the aggregation can be continued for 3 hours. This is usually sufficient time to provide a narrow GSD. The temperature is a factor in controlling the particle size and GSD in the initial stage of aggregation (kinetically controlled), the lower the temperature of aggregation, the smaller the particles; and the particle size and GSD achieved in the aggregation step can be "frozen" by addition of extra anionic surfactant prior to the coalescence. The resulting aggregated particles are heated 20° to 40° C. above their polymer Tg for coalescence for a period of from about 2 to about 6 hours, followed by washing with water to remove the surfactants using typical filtration and separation techniques; and the particles are dried in a freeze dryer, spray dryer, or fluid bed dryer.

Additionally, in another object of the present invention there are provided processes for the preparation of toners wherein a charge enhancing additive is added after aggregation in the emulsion/aggregation processes illustrated herein. Charge control agents (CCA), such as BONTRON E88™, TRH, LH-120, KTPB, which are all negative charging CCA, and the like, or CCAs such as CPC (cetyl pyridinium chloride) DDABS (distearyl dimethyl ammonium bisulfate), DDAMS (distearyl dimethyl ammonium methyl sulfate), which are all positive CCAs and the like, can all be dispersed in the stabilizer solution, which solution is then added to the aggregates prior to raising the reactor temperature by 20° to 40° C. above the resin Tg to accomplish the coalescence step.

These and other objects of the present invention are accomplished in embodiments by the provision of toners and processes thereof. In embodiments of the present invention, there are provided processes for the economical direct preparation of toner compositions by improved flocculation or heterocoagulation, and coalescence, and wherein the temperature of aggregation can be utilized to control the toner particle size, that is average volume diameter, and wherein low shear is selected.

In embodiments, the present invention is directed to processes for the preparation of toner composition particles, which comprises initially attaining or generating an ionic pigment dispersion by, for example, dispersing an aqueous mixture of a pigment or pigments, such as carbon black like REGAL 330®, cyan, magenta, or yellow pigment dispersions obtained from Sun Chemicals, wherein the pigment therein is of submicron size, that is for example less than about 1 micron, in a nonionic dispersant stabilizer to which a cationic surfactant, such as benzalkonium chloride is added, thereafter mixing this aqueous pigment dispersion with an agitator, and preferably a four bladed speed impeller, operating at from about 100 to about 900 rpm, with a suspended resin mixture comprised of polymer components, such as poly(styrene butadiene) or poly(styrene butylacrylate); and wherein the particle size of the suspended resin mixture is, for example, from about 0.01 to about 0.5 micron in an aqueous surfactant mixture containing an anionic surfactant, such as sodium dodecylbenzene sulfonate, and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; heating below about the resin Tg, for example from about 5° to about 15° C., and allowing the formation of electrostatically stabilized aggregates ranging from about 0.5 micron to about 10 microns; followed by heating above the resin Tg, for example from about 5° to about 50° C., in the presence of added anionic stabilizer, which stabilizer concentration is selected in the amount range of 1 to 5 percent by weight of the reactor contents, and which stabilizer permits retention of the particle size and the particle size distribution during the coalescence step, followed by washing with, for example, water to remove, for example, surfactant, and drying such as by use of an aeromatic fluid bed dryer, freeze dryer, or spray dryer; whereby toner particles comprised of resin pigment, and optional charge control additive with various particle size diameters can be obtained, such as from about 1 to about 10 microns in volume average particle diameter as measured by the Coulter Counter.

Embodiments of the present invention include a process for the preparation of toner compositions comprised of resin and pigment comprising (i) preparation of a latex, which latex is comprised of submicron polymeric resin particles, an ionic surfactant, and a nonionic surfactant;

(ii) preparing a pigment dispersion, which dispersion is comprised of a pigment, a dispersing liquid containing a pigment dispersion aid, a counterionic surfactant with a charge polarity of opposite sign to that of the ionic surfactant, and optionally a charge control agent;

(iii) mixing the said pigment dispersion with the latex by a stirrer equipped with an impeller, stirring at speeds of 100 to 900 rpm for a period of 10 minutes to 150 minutes;

(iv) heating the resulting homogenized mixture below about the resin Tg at a temperature of from about 35° to about 50° C. (or 5° to 20° C. below the resin Tg) thereby causing flocculation or heterocoagulation of the formed particles of pigment, resin and charge control agent to form electrostatically bounded toner size aggregates; and (v) adding more or extra aqueous ionic stabilizer in the range amount of about 0.1 percent to 5 percent by weight of the reactor contents to stabilize the above electrostatically bound aggregates;

(vi) heating to, for example, from about 60° to about 95° C. the statically bound aggregated particles of (iii) to form the toner comprised of polymeric resin and pigment, and optionally charge control agent;

(vii) isolating the toner, followed by washing with water; and (viii) drying the toner particles.

In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants. In other instances, the use of predispersed pigments where the pigment is in the submicron size, stabilized by a nonionic dispersant is preferred since no additional equipment, such as polytron or attritors or microfluidizer, is needed.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™, a polyester resin (Reichhold Chemical Inc.), PLASTHALL™, a polyester (Rohm & Hass), CYGLAS™, a polyester molding compound (American Cyanamid Company), ARMCO™, a polyester (Armco Composites), CELANEX™, a glass reinforced thermoplastic polyester (Celanese Corporation), RYNITE™, a thermoplastic polyester (DuPont), STYPOL™, a polyester with styrene monomer (Freeman Chemical Corporation), and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly (styrene butylacrylate acrylic acid) or poly(styrene butadiene acrylic acid).

The resin selected for the process of the present invention is preferably prepared by emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional, and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites. As colored pigments, there can be selected cyan, magenta, yellow, red, green, brown, blue or mixtures thereof. Specific examples of pigments are as illustrated in the Color Index, such as phthalocyanine including HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, ED. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives as indicated herein, and selected in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like. The charge additive can be included in the pigment dispersion, the latex dispersion, or added subsequently, for example, after washing to remove surfactants.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregate comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLES

Preparation of the Toner Resin:

The latex was prepared by an emulsion polymerization process, which latex was selected for the preparation of toner particles in the aggregation process of the present invention.

Latex A:

An organic phase of 93.2 kilograms of styrene, 20.5 kilograms of butyl acrylate, 2.27 kilograms of acrylic acid, 3.98 kilograms of dodecanethiol and 1.1 kilograms of carbon tetrabromide was mixed in a 100 gallon stainless steel reactor with 170 kilograms of deionized water in which 2.6 kilograms of sodium dodecyl benzene sulfonate (SDBS) anionic surfactant (NEOGEN R™, which contains 60 percent of active SDBS and 40 percent water component), 2.4 kilograms of polyoxyethylene nonyl phenyl ether nonionic surfactant (ANTAROX 897™, 70 percent active, polyethoxylated alkylphenols), and 1.1 kilograms of ammonium persulfate initiator were dissolved. The emulsion was then emulsified in the 100 gallon reactor at 110 rpm, 23° C. for 15 minutes, then polymerized at 70° C. for 6 hours. A latex containing 60 percent water and 40 percent solids of polymeric particles comprised of a copolymer of styrene, butyl acrylate and acrylic acid with a particle size of 168 nanometers, as measured on a Brookhaven nanosizer, was obtained. The solids had a Tg=56.1° C., as measured on a DuPont DSC; an $M_w$=20,700, and an $M_n$=5,300, as determined on a Hewlett Packard GPC.

Latex B:

In a similar manner to the above process for the preparation of Latex A, a second latex was prepared, the difference being that the emulsion was emulsified in the 100 gallon reactor at 125 rpm, at 23° C. for 30 minutes. A latex containing 60 percent water and 40 percent solids of polymeric particles comprised of a copolymer of styrene, butyl acrylate and acrylic acid with a particle size of 176 nanometers, as measured on a Brookhaven nanosizer, was obtained. The solids possessed a Tg=57.1° C., as measured on a DuPont DSC; an $M_w$=21,300, and an $M_n$=6,400, as determined on a Hewlett Packard GPC.

TONER FABRICATION:

EXAMPLE I

A pigment mixture of 2.0 kilograms of the SUNSPERSE BLUE™ (BHD 6000) dispersion, obtained form Sun Chemicals, 0.66 kilogram of the cationic surfactant (SANIZOL B™) and 63.5 kilograms of water was simultaneously added with 68.8 kilograms of the above Latex A into a 100 gallon stainless steel baffled reactor which contained 106 kilograms of water. The mixture was mixed for 60 minutes using a 26 inch four-blade impeller running at 350 rpm. The resulting product was then heated to 50° C. and held there for 90 minutes. The aggregate product had a diameter of 6.8 microns with a GSD of 1.20 as determined by particle diameter measurements using the Coulter Counter (Microsizer II). At this point, the agitator speed was reduced from 350 rpm down to 90 rpm and 8 kilograms of anionic surfactant (NEOGEN R™) solution having a concentration of 20 percent by weight in water was added to the reactor contents to prevent the formed aggregates from further aggregating and increasing in size during the coalescence step.

The reactor contents were then heated to 93° C. while mixing at 90 rpm for about 4 hours. The particle size was measured on the Coulter Counter. Toner particles of 6.9 microns were obtained with a GSD=1.20, indicating no further growth in the particle size. The toner particles were then washed with water and dried. The aforementioned cyan toner was comprised of 96.3 percent of 88 parts of polystyrene, 12 parts of polybutylacrylate, 2 parts of polyacrylic acid and 3.7 percent of BHD 6000 phthalocyanine pigment particles. The yield of toner particles was 98 percent.

COMPARATIVE EXAMPLE 1

A pigment mixture of 2.0 kilograms of the SUNSPERSE BLUE™ (BHD 6000) dispersion, 0.66 kilogram of a cationic surfactant (SANIZOL B™) and 63.5 kilograms of water was simultaneously added with 68.8 kilograms of the above Latex A into a 100 gallon stainless steel baffled reactor, which contained 106 kilograms of water, while simultaneously applying a high shear using a high speed rotator-stator device, such as a multistage rotor-stator at speeds of 3,600 rpm. The sheared mixture was then recirculated through the 100 gallon reactor for a period of 15 minutes. The reactor contents were then heated up to 50° C. and held there for 90 minutes. The aggregate product had a diameter of 6.7 microns with a GSD of 1.21 as determined by particle diameter measurements using the Coulter Counter (Microsizer II). At this point, the agitator speed was reduced from 350 rpm down to 90 rpm and 8 kilograms of anionic surfactant (NEOGEN R™) solution having a concentration of 20 percent by weight in water was added to the reactor contents to prevent the formed aggregates from further aggregating and increasing in size during the coalescence step.

The reactor contents were then heated to 93° C. while mixing at 90 rpm for about 4 hours. The particle size was measured on the Coulter Counter. Toner particles of 6.8 microns were obtained with a GSD=1.21, indicating no further growth in the particle size. The toner particles were then washed with water and dried. The aforementioned cyan toner was comprised of 96.3 percent of 88 parts of polystyrene, 12 parts of polybutylacrylate, 2 parts of polyacrylic acid and 3.7 percent of phthalocyanine pigment particles. The yield of toner particles was 98 percent.

EXAMPLE II

A pigment mixture comprised of 2.0 kilograms of the SUNSPERSE BLUE™ (BHD 6000) dispersion, obtained from Sun Chemicals, 0.66 kilogram of the cationic surfactant (SANIZOL B™) and 63.5 kilograms of water was simultaneously added with 68.8 kilograms of the above Latex B into a 100 gallon stainless steel baffled reactor, which contained 106 kilograms of water. The mixture was mixed for 60 minutes using a 26 inch four-bladed impeller running at 350 rpm. The resulting product was then heated to 50° C. and held there for 90 minutes. The aggregate product had a diameter of 7.0 microns with a GSD of 1.21 as determined by particle diameter measurements using the Coulter Counter (Microsizer II). At this point, the agitator speed was reduced from 350 rpm down to 90 rpm and 8 kilograms of anionic surfactant (NEOGEN R™) solution having a concentration of 20 percent by weight in water was added to the reactor contents to prevent the formed aggregates from further aggregating and increasing in size during the coalescence step.

The reactor contents were then heated to 93° C. while mixing at 90 rpm for about 4 hours. The particle size was measured on the Coulter Counter. Particles of 7.1 microns were obtained with a GSD=1.21, indicating no further growth in the particle size. The toner particles were then washed with water and dried. The aforementioned cyan toner was comprised of 96.3 percent of 88 parts of polystyrene, 12 parts of polybutylacrylate, 2 parts of polyacrylic acid, and 3.7 percent of phthalocyanine pigment particles. The yield of toner particles was 98 percent.

COMPARATIVE EXAMPLE 2

A pigment mixture consisting of 2.0 kilograms of the SUNSPERSE BLUE™ (BHD 6000) dispersion, 0.66 kilogram of a cationic surfactant (SANIZOL B™) and 63.5 kilograms of water was simultaneously added with 68.8 kilograms of the above Latex B into a 100 gallon stainless steel baffled reactor, which contained 106 kilograms of water while simultaneously applying a high shear using a high speed rotator-stator device of Example I at speeds of 3,600 rpm. The sheared mixture was recirculated through the 100 gallons for a period of 15 minutes. The reactor contents were then heated up to 50° C. and held there for 90 minutes. The aggregate product had a diameter of 6.9 microns with a GSD of 1.20 as determined by particle diameter measurements using the Coulter Counter (Microsizer II). At this point, the agitator speed was reduced from 350 rpm down to 90 rpm, and 8 kilograms of anionic surfactant (NEOGEN R™) solution having a concentration of 20 percent by weight in water was added to the reactor contents to prevent the formed aggregates from further aggregating and increasing in size during the coalescence step.

The reactor contents were then heated to 93° C. while mixing at 90 rpm for about 4 hours. The particle size was measured on the Coulter Counter. Particles of 7.0 microns were obtained with a GSD=1.20, indicating no further growth in the particle size. The toner particles were then washed with water and dried. The aforementioned cyan toner was comprised of 96.3 percent of 88 parts of polystyrene, 12 parts of polybutylacrylate, 2 parts of polyacrylic acid, and 3.7 percent of phthalocyanine pigment particles. The yield of toner particles was 98 percent. The yield of toner particles was 98 percent.

With the above Comparative Examples there resulted some seal leaks, and equipment line plugging not observed with the invention Examples.

Other modifications of the present invention may occur to those skilled in the art subsequent to a review of the present application and these modifications, including equivalents thereof, are intended to be included within the scope of the present invention.

What is claimed is:

1. An in situ chemical process for the preparation of toner comprised of (i) the provision of a latex, which latex is comprised of polymeric resin particles, an ionic surfactant and a nonionic surfactant;

(ii) providing a pigment dispersion, which dispersion is comprised of a pigment, a dispersing liquid, a counterionic surfactant with a charge polarity of opposite sign to that of said ionic surfactant, and optionally a charge control agent;

(iii) mixing said pigment dispersion with said latex with a stirrer equipped with an impeller, stirring at speeds of from about 100 to about 900 rpm for a period of from about 10 minutes to about 150 minutes;

(iv) heating the above resulting blend of latex and pigment dispersion to a temperature below about the glass transition temperature (Tg) of the resin to form electrostatically bound toner size aggregates;

(v) adding further aqueous ionic surfactant or stabilizer in the range amount of from about 0.1 percent to 5 percent by weight of reactants to stabilize the above electrostatically bound toner size aggregates;

(vi) heating said electrostatically bound toner sized aggregates above about the Tg of the resin to form toner size particles containing pigment, resin and optionally a charge control agent;

(vii) optionally isolating said toner, optionally washing with water; and optionally (viii) drying said toner.

2. A process in accordance with claim 1 (iii) wherein the mixing is from about 150 to about 600 rpm for a duration of from about 30 minutes to about 90 minutes.

3. A process in accordance with claim 1 (ii) wherein the counterionic surfactant for the pigment dispersion is a cationic surfactant, and the ionic surfactant present in the latex mixture is an anionic surfactant.

4. A process in accordance with claim 1 (iii) wherein the mixing is accomplished with impellers operating at speeds of from about 150 to about 600 rpm.

5. A process in accordance with claim 1 wherein the dispersion of (ii) is prepared with stirring at speeds of from about 100 revolutions per minute to about 900 revolutions per minute at a temperature of from about 25° C. to about 35° C., and for a duration of from about 1 minute to about 60 minutes.

6. A process in accordance with claim 1 wherein the charge control agent is dispersed in the stabilizer in (v).

7. A process in accordance with claim 1 wherein the heating of the blend comprising latex, pigment, surfactants and optional charge control agent in (iv) is accomplished at temperatures of from about 20° C. to about 5° C. below the Tg of the resin for a duration of from about 0.5 hour to about 6 hours.

8. A process in accordance with claim 1 (vi) wherein the heating of the statically bound toner aggregate particles to form toner size composite particles comprised of pigment, resin and optional charge control agent is accomplished at a temperature of from about 10° C. above the Tg of the resin to about 95° C. for a duration of from about 1 hour to about 8 hours.

9. A process in accordance with claim 1 (i) wherein the resin is selected from the group consisting of poly(styrene-butadiene), poly(para-methyl styrene-butadiene), poly (meta-methylstyrene-butadiene), poly(alpha-methylstyrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly (alpha-methylstyrene-isoprene), poly(methylmethacrylate-isoprene), poly(ethylmethacrylate-isoprene), poly (propylmethacrylate-isoprene), poly(butyl methacrylate-isoprene), poly(methylacrylate-isoprene), poly (ethylacrylate-isoprene), poly(propylacrylate-isoprene), and poly(butylacrylate-isoprene), and wherein each of said resins contain acrylic acid.

10. A process in accordance with claim 1 (i) wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, the anionic surfactant is selected from the group consisting of sodium dodecyl sulfate, sodium dodecylbenzene sulfate, and sodium dodecylnaphthalene sulfate, and the counterionic surfactant is a cationic surfactant of a quaternary ammonium salt.

11. A process in accordance with claim 1 wherein the pigment is carbon black, magnetite, a cyan pigment, a yellow pigment, a magenta pigment, or mixtures thereof.

12. A process in accordance with claim 1 wherein the toner isolated is from about 2 to about 15 microns in volume average diameter, the geometric size distribution (GSD) thereof is narrow and is from about 1.15 to about 1.20, and the aggregates formed in (iv) are from about 1 to about 10 microns in volume average diameter.

13. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge control agent.

14. A process in accordance with claim 1 wherein the toner is isolated and dried, and thereafter there is added to said toner surface metal salts, metal salts of fatty acids, silicas, metal oxides, or mixtures thereof, each in an amount of from about 0.1 to about 10 weight percent of the formed toner.

15. A process in accordance with claim 1 wherein the toner is washed with water and the surfactants are removed from the toner surface, followed by drying.

16. A process in accordance with claim 10 wherein the nonionic surfactant is linear or branched.

17. A process in accordance with claim 1 wherein heating in (iv) is from about 5° C. to about 25° C. below the resin Tg, or wherein said heating in (iv) is accomplished at a temperature of from about 29° C. to about 59° C., and wherein heating in (vi) is from about 5° to about 50° C. above the Tg, and wherein the resin Tg in (vi) is from about 50° to about 80° C.

18. A process for the preparation of pigmented toner size particles comprised of mixing a pigment dispersion with a latex, which mixing is accomplished with stirring at speeds of from about 100 to about 900 revolutions per minute and wherein the pigment dispersion is comprised of a pigment, a dispersing liquid containing a pigment dispersion component, a counterionic surfactant with a charge polarity of opposite sign to that of the ionic surfactant, and optionally a charge control agent; and wherein the latex is comprised of submicron polymeric resin particles, an ionic surfactant and a nonionic surfactant; heating the above formed blend of latex and pigment dispersion to a temperature below about the glass transition temperature (Tg) of the resin to form toner aggregates; adding further ionic surfactant or stabilizer in the range amount of from about 0.1 percent to about 5 percent by weight of latex and resin components to stabilize said aggregates; and thereafter, heating the toner aggregates above about the resin Tg.

19. A process in accordance with claim 18 wherein the stirrer is an impeller operating at speeds of from about 100 to about 900 rpm for a period of from 10 minutes to about 150 minutes.

20. A process in accordance with claim 18 wherein said submicron is less than about 1 micron.

21. A process in accordance with claim 18 wherein said submicron is from about 0.001 to about 0.99 micron in volume average diameter.

22. A process in accordance with claim 1 wherein said resin is of submicron size of from about 0.001 to about 0.99 micron in volume average diameter.

23. A process for the preparation of toner, which process comprises the mixing of a pigment dispersion with a latex and which mixing is accomplished at low stirring speeds of from about 100 to about 900 revolutions per minute, and wherein the pigment dispersion is comprised of a pigment, a dispersing liquid containing a pigment dispersion component, and a counterionic surfactant with a charge polarity of opposite sign to that of the ionic surfactant; and wherein the latex is comprised of polymeric resin particles, an ionic surfactant, and a nonionic surfactant; a first heating of the above formed blend of latex and pigment dispersion to a temperature below about, or at the glass transition temperature (Tg) of the resin, to form aggregates; optionally adding further ionic surfactant or stabilizer; thereafter a second heating of the toner aggregates above about, or at the resin Tg; isolating and drying said toner.

24. A process in accordance with claim 23 wherein there is added further ionic surfactant or stabilizer in the amount of from about 0.1 percent to about 5 percent by weight of latex and resin components to stabilize said aggregates; and wherein the first heating is below the resin Tg, and the second heating is above the resin Tg.

25. A process in accordance with claim 23 wherein said resin is submicron in size and said submicron is from about 0.001 to about 0.99 microns in volume average diameter.

* * * * *